US012060528B2

(12) United States Patent
Kashyap

(10) Patent No.: US 12,060,528 B2
(45) **Date of Patent: *Aug. 13, 2024**

(54) MULTIPLE DENSE PHASE RISERS TO MAXIMIZE LIGHT OLEFINS YIELDS FOR NAPHTHA CATALYTIC CRACKING

(71) Applicant: SABIC Global Technologies B.V., Bergen op Zoom (NL)

(72) Inventor: Mayank Kashyap, Sugar Land, TX (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 16 days.

This patent is subject to a terminal disclaimer.

(21) Appl. No.: 17/632,555

(22) PCT Filed: Jul. 21, 2020

(86) PCT No.: PCT/IB2020/056845

§ 371 (c)(1),
(2) Date: Feb. 3, 2022

(87) PCT Pub. No.: WO2021/024067

PCT Pub. Date: Feb. 11, 2021

(65) Prior Publication Data

US 2022/0275288 A1 Sep. 1, 2022

Related U.S. Application Data

(60) Provisional application No. 62/883,059, filed on Aug. 5, 2019.

(51) Int. Cl.
*C10G 11/18* (2006.01)

(52) U.S. Cl.
CPC .... *C10G 11/187* (2013.01); *C10G 2300/1044* (2013.01); *C10G 2300/4018* (2013.01);
(Continued)

(58) Field of Classification Search
CPC ..... C10G 11/187; C10G 2300/1044; C10G 2300/4018; C10G 2300/807; C10G 2400/20; C10G 2400/30
See application file for complete search history.

(56) References Cited

U.S. PATENT DOCUMENTS 3,974,062 A 8/1976 Owen et al.
4,300,997 A * 11/1981 Meguerian ..... C10G 11/18 423/247

(Continued)

FOREIGN PATENT DOCUMENTS

CN 1910264 A 2/2007
CN 103725321 A 4/2014

(Continued)

OTHER PUBLICATIONS

International Search Report and Written Opinion from PCT/IB2020/056845 dated Nov. 3, 2020, 14 pages.

*Primary Examiner* — In Suk C Bullock
*Assistant Examiner* — Jason Y Chong
(74) *Attorney, Agent, or Firm* — Norton Rose Fulbright US LLP

(57) ABSTRACT

Systems and methods for producing light olefins via catalytic cracking of naphtha are disclosed. A naphtha feed stream and lift gas stream are fed into a plurality of dense phase riser reactors, each of which is operated with a high solid volume fraction, a high superficial velocity, and minimum back mixing. The effluent stream from each dense phase riser reactor is further separated, in a secondary reactor, to form a gaseous product stream and a catalyst stream. The catalyst stream is stripped to remove the hydrocarbons adsorbed on the catalyst particles. The stripped catalyst is regenerated in a regenerator.

18 Claims, 2 Drawing Sheets

(52) U.S. Cl.
CPC ... *C10G 2300/807* (2013.01); *C10G 2400/20* (2013.01); *C10G 2400/30* (2013.01)

(56) References Cited

U.S. PATENT DOCUMENTS

| | | | | |
|---|---|---|---|---|
| 4,436,613 | A | 3/1984 | Sayles et al. | |
| 4,830,728 | A | 5/1989 | Herbst et al. | |
| 4,966,681 | A | 10/1990 | Herbst et al. | |
| 7,083,762 | B2 * | 8/2006 | Kuechler | C07C 51/252 208/78 |
| 7,491,315 | B2 | 2/2009 | Eng et al. | |
| 8,383,052 | B2 | 2/2013 | Niccum | |
| 2004/0076554 | A1 | 4/2004 | Kuechler et al. | |
| 2006/0073083 | A1 | 4/2006 | Beech, Jr. et al. | |
| 2009/0012339 | A1 | 1/2009 | Choi et al. | |
| 2014/0014555 | A1 | 1/2014 | Marri et al. | |
| 2014/0356248 | A1 * | 12/2014 | Mehlberg | B01J 8/1845 422/187 |
| 2016/0074847 | A1 * | 3/2016 | Al-Hazmi | B01J 29/40 585/653 |
| 2018/0079973 | A1 | 3/2018 | Chen et al. | |

FOREIGN PATENT DOCUMENTS

| | | | |
|---|---|---|---|
| CN | 103732726 | A | 4/2014 |
| CN | 103814114 | A | 5/2014 |
| CN | 107961744 | A | 4/2018 |
| CN | 109705905 | A | 5/2019 |
| EP | 0259155 | A1 | 3/1988 |

* cited by examiner

MULTIPLE DENSE PHASE RISERS TO MAXIMIZE LIGHT OLEFINS YIELDS FOR NAPHTHA CATALYTIC CRACKING

CROSS REFERENCE TO RELATED APPLICATIONS

This application is a national phase application under 35 U.S.C. § 371 of International Application No. PCT/IB2020/056845 filed Jul. 21, 2020, which claims priority to U.S. Provisional Patent Application No. 62/883,059 filed Aug. 5, 2019. The entire contents of each of the above-referenced disclosures is specifically incorporated by reference herein without disclaimer.

FIELD OF INVENTION

The present invention generally relates to systems and methods for producing light olefins. More specifically, the present invention relates to systems and methods for producing light olefins via catalytically cracking naphtha in dense phase riser reactors.

BACKGROUND OF THE INVENTION

Light olefins ($C_2$ to $C_4$ olefins) are building blocks for many chemical processes. Light olefins are used to produce polyethylene, polypropylene, ethylene oxide, ethylene chloride, propylene oxide, and acrylic acid, which, in turn, are used in a wide variety of industries such as the plastic processing, construction, textile, and automotive industries. Generally, light olefins are produced by steam cracking naphtha and dehydrogenating paraffin.

Over the last few decades, the demand for light olefins has been consistently increasing. For one of the conventional methods of producing light olefins, the overall efficiency is relatively low because the overall selectivity of naphtha to light olefins is limited. Consequently, the steam cracking process generates a large amount of hydrocarbons that are recycled to the steam cracking unit. As hydrocarbons have to be hydrogenated before they are recycled back to the steam cracking unit, the large amount of hydrocarbons for recycling can demand a large amount of hydrogen and energy in the hydrogenation process, resulting in high production cost.

Another method for producing light olefins includes catalytic cracking of naphtha in a conventional fluidized bed reactor. However, due to back mixing in the fluidized bed reactor, the yield for light olefins can be relatively low. Furthermore, conventional fluidized bed reactors for catalytic cracking are usually operated with low average solid volumetric fraction and low gas-solids contact efficiency due to the limitation of superficial gas velocities in the fluidized bed. Therefore, the conventional methods often result in high methane formation due to thermal cracking and increased production cost for light olefins. Overall, while methods of producing light olefins exist, the need for improvements in this field persists in light of at least the aforementioned drawbacks for the methods.

BRIEF SUMMARY OF THE INVENTION

A solution to at least some of the above-mentioned problems associated with the production process for light olefins using naphtha as the feed material has been discovered. The solution resides in a method of producing light olefins that includes using a plurality of dense phase riser reactors to catalytically crack naphtha. The superficial gas velocity in each of the dense phase riser reactors is significantly higher than the conventional methods. This can be beneficial for at least providing high solid volumetric fraction in the dense phase riser reactors, thereby reducing the occurrence of thermal cracking of the naphtha. Additionally, the lift gas used in the dense phase riser reactors does not contain steam. Thus, zeolite based catalyst, which has higher efficiency than non-zeolite based catalyst, can be used and is not subject to de-alumination by steam. Moreover, this method limits the back mixing in the dense phase riser reactors, which is characterized by wide residence time distribution (RTD) with relative variance of less than 0.25, resulting in improved olefins to aromatics ratio in the effluent from each of the dense phase riser reactors. Therefore, the method of the present invention provides a technical solution to at least some of the problems associated with the currently available methods for producing light olefins mentioned above.

Embodiments of the invention include a method of producing light olefins. The method comprises contacting, in a plurality of dense phase riser reactors, naphtha with catalyst particles under reaction conditions sufficient to produce a first product comprising one or more olefins. The reaction conditions comprise a solid volume fraction of 0.06 to 0.12 in the dense phase riser reactors. The method comprises flowing a mixture of the first product, the catalyst particles, and unreacted naphtha to a cyclone system disposed in a secondary reactor, wherein the secondary reactor is stacked on top of a catalyst regenerator.

Embodiments of the invention include a method of producing light olefins. The method comprises contacting, in a plurality of dense phase riser reactors, naphtha with catalyst particles under reaction conditions sufficient to produce a first product comprising one or more olefins. The reaction conditions comprise a solid volume fraction of 0.06 to 0.12 in the dense phase riser reactors. The method comprises flowing a mixture of the first product, the catalyst particles, and unreacted naphtha from one or more of the dense phase riser reactors to a cyclone system disposed in a secondary reactor, wherein the secondary reactor is stacked on top of a catalyst regenerator. The method comprises separating, in the cyclone system, the first product from the catalyst particles. The method comprises stripping, in a stripper disposed in the regenerator, hydrocarbon vapor from the catalyst particles to produce stripped catalyst particles. The method comprises regenerating, in the regenerator, the stripped catalyst particles. The method further comprises flowing regenerated catalyst particles to one or more of the dense phase riser reactors.

Embodiments of the invention include a reaction unit for producing olefins. The reaction unit includes a plurality of dense phase riser reactors. Each of the dense phase riser reactors comprises a housing, a feed inlet disposed on a lower half of the housing and adapted to receive a feed material into the housing, a lift gas inlet disposed on the lower half of the housing and adapted to receive a lift gas into the housing, a catalyst inlet disposed on the lower half of the housing and adapted to receive catalyst into the housing, and an outlet disposed on the top half of the housing and adapted to release an effluent of the dense phase riser from the housing. The reaction unit further includes a secondary reactor in fluid communication with the outlet of each of the dense phase riser reactors. The secondary reactor comprises one or more cyclones adapted to separate the effluent of each of the dense phase riser reactors to form a gaseous stream comprising gaseous products and a solid stream comprising the catalyst. The reaction unit further still includes a regenerator in fluid communication with the secondary reactor, adapted to receive the solid stream from the secondary reactor and regenerate the catalyst of the solid stream. The regenerator is in fluid communication with the catalyst inlet of each of the dense phase riser reactors.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The term "raffinate," as the term is used in the specification and/or claims, means the rest of a product stream, from which a target component or components have been removed.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

Currently, light olefins including ethylene, propylene, butenes can be produced by steam cracking or catalytic cracking of naphtha. However, the overall conversion rate to light olefins for steam cracking naphtha is relatively low. Furthermore, the production costs for steam cracking naphtha are high as steam cracking of naphtha produces a large amount of raffinate, which needs to be hydrogenated before it is recycled back to the steam cracking unit. Thus, the large amount of raffinate results in high demand for hydrogen and energy in the hydrogenation process. Conventional processes of catalytically cracking naphtha generally have relatively low superficial gas velocities and extremely high catalyst to oil ratio in the catalyst bed, which leads to challenges to maintain pressure balance in the reactor. Furthermore, the conventional catalytic cracking of naphtha uses steam as lift gas, which prevents using zeolite based catalyst, which has a high catalytic efficiency for light olefins production. The present invention provides a solution to at least some of these problems. The solution is premised on a method including catalytically cracking naphtha in a reaction unit that comprises a plurality of dense phase riser reactors. This method is capable of retaining high solid volumetric fraction along with a high superficial gas velocity in the dense phase riser reactors, thereby reducing the thermal cracking of naphtha and increasing yield of light olefins. Moreover, this method limits back mixing of the catalyst and hydrocarbons in the dense phase riser reactors. Thus, the selectivity to light olefins is increased over conventional methods. Additionally, this method can use a lift gas that does not contain steam such that zeolite based catalyst can be used in the reaction unit, resulting in improved light olefins production efficiency. These and other non-limiting aspects of the present invention are discussed in further detail in the following sections.

A. System for Catalytically Cracking Naphtha to Produce Light Olefins

Figure 1:
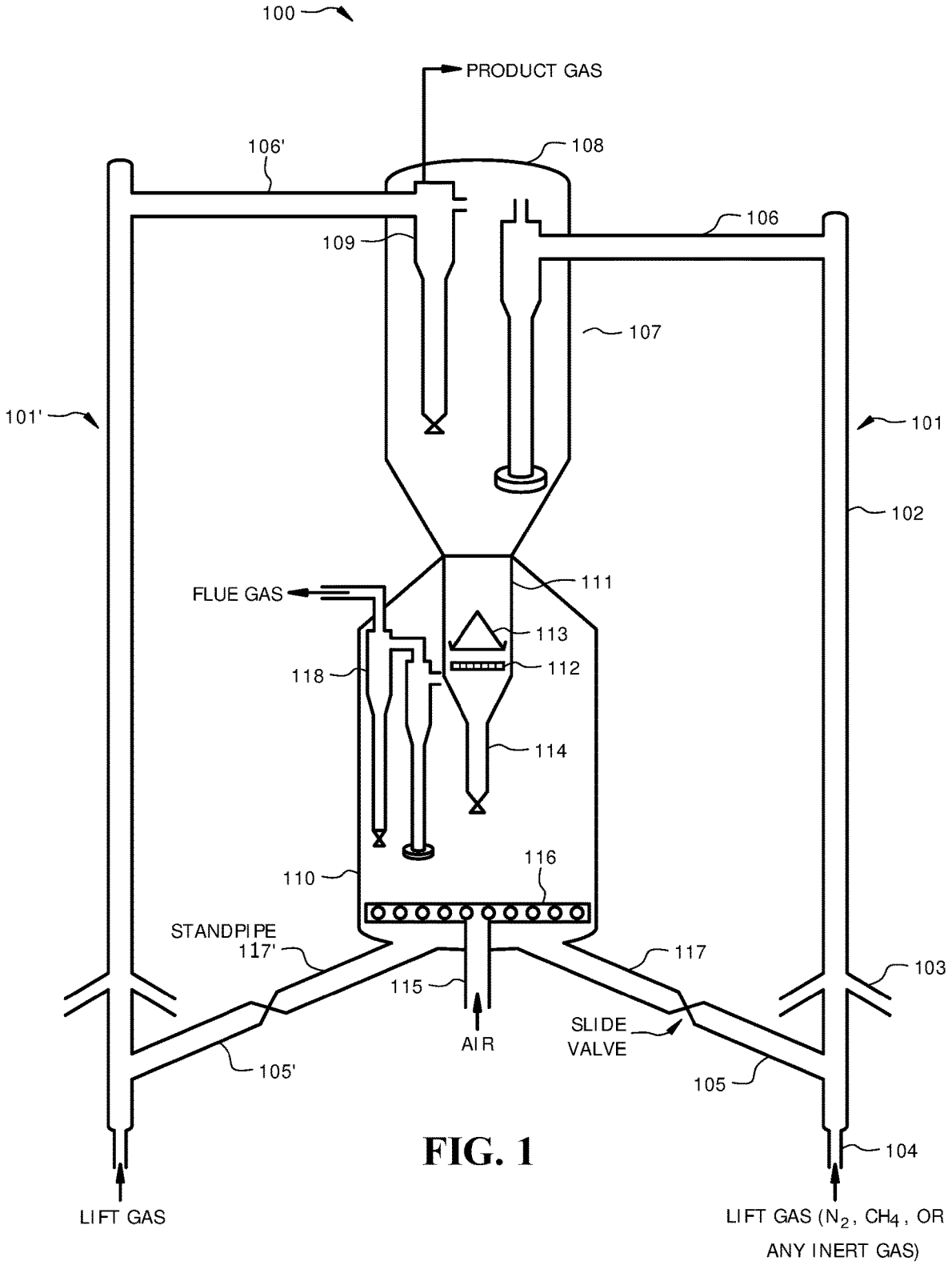
FIG. 1 shows a schematic diagram of a reaction unit for producing light olefins, according to embodiments of the invention.

In embodiments of the invention, a reaction unit for producing light olefins via catalytic cracking of naphtha comprises a plurality of dense phase riser reactors, a secondary reactor for gas-solid separation, and a regenerator. With reference to FIG. 1, a schematic diagram is shown of reaction unit 100 that is configured to produce light olefins (e.g., $C_2$ to $C_4$ olefins) and with improved production efficiency and yield of light olefins, compared to conventional steam cracking or catalytic cracking processes. According to embodiments of the invention, reaction unit 100 includes a plurality of dense phase riser reactors (e.g., dense phase riser reactors 101 and 101'). In embodiments of the invention, reaction unit 100 includes 2 to 4 dense phase riser reactors. Each dense phase riser reactor (e.g., dense phase reactor 101) may comprise housing 102, feed inlet 103, lift gas inlet 104, catalyst inlet 105, and effluent outlet 106. In embodiments of the invention, each dense phase riser reactor 101 comprises a fluidized bed reactor.

In embodiments of the invention, housing 102 is made of carbon steel, refractory, or combinations thereof. Housing 102 is adapted to host catalytic cracking of naphtha. According to embodiments of the invention, feed inlet 103 may be disposed at a lower half of housing 102 and adapted to receive a feed stream therein. In embodiments of the invention, the feed stream includes naphtha. In embodiments of the invention, lift gas inlet 104 is disposed at the lower half of housing 102 and adapted to receive a lift gas stream in housing 102. In embodiments of the invention, lift gas inlet 104 may be disposed below feed inlet 103. The lift gas stream may include nitrogen, methane, any inert gas, or combinations thereof. In embodiments of the invention, catalyst inlet 105 is disposed on lower half of housing 102. Catalyst inlet 105 may be adapted to receive catalyst particles into housing 102. Non-limiting examples for the catalyst particles may include zeolite. According to embodiments of the invention, the catalyst particles have a particle size in a range of 75 to 120 μm and all ranges and values there between including ranges of 75 to 78 μm, 78 to 81 μm, 81 to 84 μm, 84 to 87 μm, 87 to 90 μm, 90 to 93 μm, 93 to 96 μm, 96 to 99 μm, 99 to 102 μm, 102 to 105 μm, 105 to 108 μm, 108 to 111 μm, 111 to 114 μm, 114 to 117 μm, and 117 to 120 μm. The catalyst particles have a density in a range of 1000 to 1700 kg/m$^3$ and all ranges and values there between including ranges of 1000 to 1100 kg/m$^3$, 1100 to 1200 kg/m$^3$, 1200 to 1300 kg/m$^3$, 1300 to 1400 kg/m$^3$, 1400 to 1500 kg/m$^3$, 1500 to 1600 kg/m$^3$, and 1600 to 1700 kg/m$^3$. The fluidized bed in each dense phase riser reactor 101 may have an overall bulk density of 70 to 145 kg/m$^3$ and all ranges and values there between including ranges of 70 to 75 kg/m$^3$, 75 to 80 kg/m$^3$, 80 to 85 kg/m$^3$, 85 to 90 kg/m$^3$, 90 to 95 kg/m$^3$, 95 to 100 kg/m$^3$, 100 to 105 kg/m$^3$, 105 to 110 kg/m$^3$, 110 to 115 kg/m$^3$, 115 to 120 kg/m$^3$, 120 to 125 kg/m$^3$, 125 to 130 kg/m$^3$, 130 to 135 kg/m$^3$, 135 to 140 kg/m$^3$, and 140 to 145 kg/m$^3$. In embodiments of the invention, catalyst inlet 105 may be disposed above lift gas inlet 104. According to embodiments of the invention, lift gas inlet 104 is disposed below feed inlet 103 and catalyst inlet 105.

In embodiments of the invention, each dense phase riser reactor 101 may be substantially cylindrical. Each dense phase riser reactor 101 may have a height to diameter ratio in a range of 8 to 27 and all ranges and values there between including ranges of 8 to 9, 9 to 11, 11 to 13, 13 to 15, 15 to 17, 17 to 19, 19 to 21, 21 to 23, 23 to 25, and 25 to 27. In embodiments of the invention, each dense phase riser reactor 101 has an inner diameter in a range of 2.0 to 2.75 m and all ranges and values there between. According to embodiments of the invention, each dense phase riser reactor 101 comprises outlet 106 (or outlet 106') in fluid communication with secondary reactor 107 such that an effluent of each dense phase riser reactor 101 flows from dense phase riser reactor 101 to secondary reactor 107.

Effluent from each of dense phase riser reactors 101 may include unreacted naphtha, light olefins, lift gas, spent catalyst particles, and any other by-products. Effluent from each dense phase riser reactor 101 may further include aromatics. According to embodiments of the invention, secondary reactor 107 is adapted to separate the effluent from each dense phase riser reactor 101 to form a product gas stream and a spent catalyst stream. The product gas stream may include light olefins, unreacted naphtha, aromatics, lift gas, by-products, or combinations thereof. The spent catalyst stream may include spent catalyst particles, hydrocarbons adsorbed on the spent catalyst particles, lift gas, or combinations thereof.

According to embodiments of the invention, secondary reactor 107 comprises secondary reactor housing 108 and one or more cyclones 109 adapted to separate the effluent from each dense phase riser reactor 101 to form a spent catalyst stream comprising spent catalyst particles and a product gas stream comprising product gases from each dense phase riser reactor 101. In embodiments of the invention, each cyclone 109 in secondary reactor 107 is single- or multiple-stage cyclone. Each cyclone 109 may be in fluid communication with a dipleg. The dipleg is adapted to transfer catalyst particles from the cyclone to the dense bed close to the bottom of secondary reactor 107. In embodiments of the invention, the dipleg for each cyclone 109 is further in fluid communication with a splash plate and/or a trickle valve. The splash plate and/or trickle valve may be adapted to avoid bypass of gas up the dipleg of a cyclone.

In embodiments of the invention, a bottom end of secondary reactor 107 may be in fluid communication with regenerator 110 such that spent catalyst stream flows from secondary reactor 107 to catalyst regenerator 110. In embodiments of the invention, regenerator 110 is adapted to strip hydrocarbons adsorbed on the spent catalyst particles and regenerate the spent catalyst after the stripping process. Regenerator 110 may be further adapted to separate flue gas from the catalyst. According to embodiments of the invention, secondary reactor 107 is stacked on top of regenerator 110 such that the spent catalyst particles can directly flow from secondary reactor 107 to regenerator 110 without any additional driving force other than gravity.

According to embodiments of the invention, regenerator 110 comprises stripper 111 configured to strip hydrocarbons adsorbed on the spent catalyst particles. Stripper 111 may comprise a stripping gas sparger 112 configured to release stripping gas for contacting the spent catalyst. Non-limiting examples for the stripping gas can include nitrogen, methane, flue gas, and combinations thereof. Stripper 111 may further comprise stripper internals 113 configured to enhance counter-current contacting between the down-flowing stream (an emulsion phase) and the up-flowing bubble stream in stripper 111. Stripper internals 113 may include disk structured internals, chevron structured internals, packing internals, subway grating internals, or combinations thereof. Stripper internals 113 may further comprise standpipe 114 adapted to transfer catalyst particles from stripper 111 to regenerator 110 and a slide valve adapted to control flow rate of catalyst particles from stripper 111 to regenerator 110. In embodiments of the invention, regenerator 110 further comprises air inlet 115 in fluid communication with air sparger 116 that is disposed in catalyst regeneration unit 112 such that air is supplied into regenerator 110 through air inlet 115 and air sparger 116. According to embodiments of the invention, regenerator 110 further comprises one or more cyclones (e.g., cyclone 118) adapted to separate flue gas from the catalyst. The flue gas may include the flue gas produced during the catalyst regeneration process. According to embodiments of the invention, regenerator 110 comprises a plurality of catalyst outlets (e.g., catalyst outlets 117 and 117'), each of which is in fluid communication with catalyst inlet 105 (or catalyst inlet 105') of each dense phase riser reactor 101 (or dense phase riser reactor 101') such that regenerated catalyst flows from regenerator 110 to each dense phase riser reactor 101.

The dense phase riser reactors (e.g., dense phase riser reactors 101 and 101') can be operated in parallel. According to embodiments of the invention, each dense phase riser reactor comprises an outlet in fluid communication with cyclone system 109 of secondary reactor 107 such that effluent from each dense phase riser reactor flows into cyclone system 109. For instance, as shown in FIG. 1, dense phase riser reactor 101 may comprise outlet 106 in fluid communication with cyclone system 109. Dense phase riser reactor 101 may comprise outlet 106' in fluid communication with cyclone system 109. According to embodiments of the invention, each dense phase riser reactor comprises a catalyst inlet in fluid communication with a catalyst outlet such that regenerated catalyst flows from regenerator 110 to each dense phase riser reactor. For example, as shown in FIG. 1, dense phase riser reactor 101 may comprise catalyst inlet 105 in fluid communication with catalyst outlet 117 of regenerator 110. Dense phase riser reactor 101' may comprise catalyst inlet 105' in fluid communication with catalyst outlet 117' of regenerator 110. The two or more dense phase riser reactors of reaction unit 100 may be configured to share secondary reactor 107 and regenerator 110 for reducing capital expenditure and energy consumption compared to using a secondary reactor and a regenerator for each dense phase riser reactor. Although two dense phase riser reactors are shown in FIG. 1, in embodiments of the invention, reaction unit 100 can include three or more dense phase riser reactors operated with one set of secondary reactor 107 and regenerator 110.

B. Method of Producing Aromatics and Olefins

Figure 2:
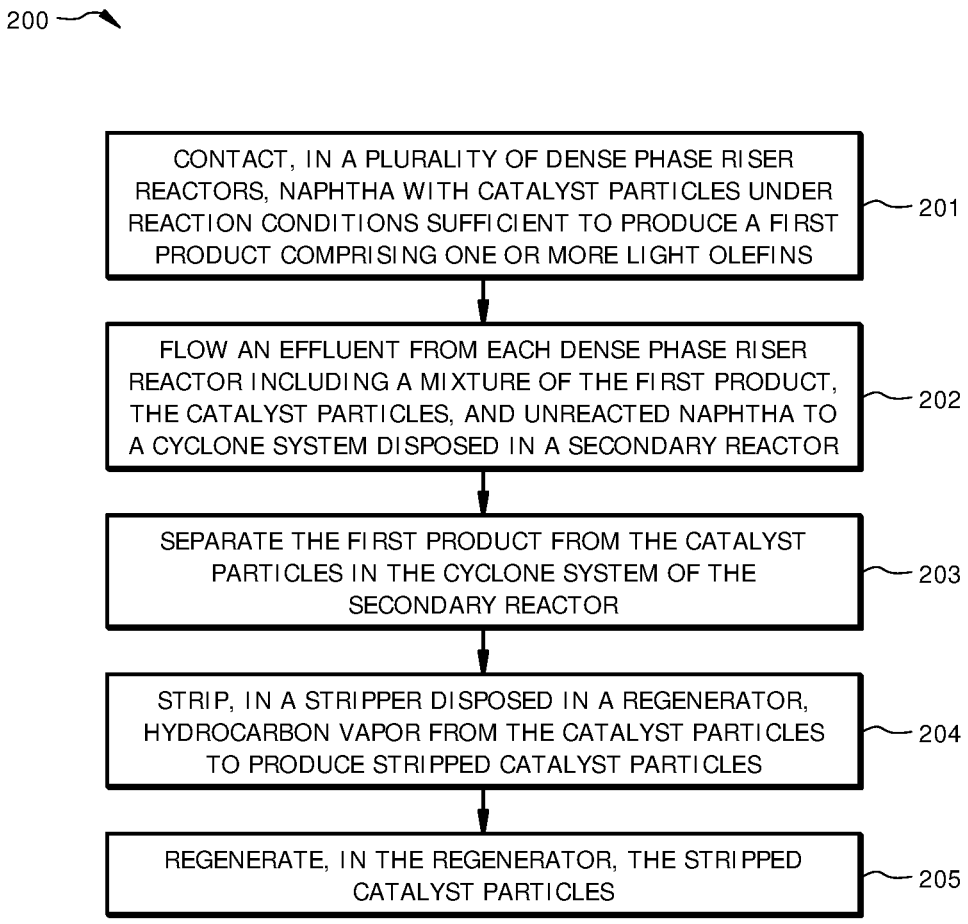
FIG. 2 shows a schematic flowchart of a method of producing light olefins, according to embodiments of the invention.

Methods of producing light olefins via catalytically cracking naphtha have been discovered. Embodiments of the method are capable of increasing solid volume fraction in the reaction unit, and minimizing occurrence of thermal cracking of hydrocarbons compared to conventional methods of catalytically cracking naphtha. Therefore, the methods may be able to significantly improve production efficiency of light olefins compared to conventional methods. As shown in FIG. 2, embodiments of the invention include method 200 for producing light olefins. Method 200 may be implemented by reaction unit 100, as shown in FIG. 1.

According to embodiments of the invention, as shown in block 201, method 200 may include contacting, in a plurality of dense phase riser reactors 101, naphtha with catalyst particles under reaction conditions sufficient to produce a first product comprising one or more light olefins. In embodiments of the invention, the contacting at block 201 includes injecting, into each dense phase riser reactor 101, the lift gas through lift gas inlet 104, naphtha through feed inlet 103, and/or catalyst through catalyst inlet 105 such that the catalyst particles and the naphtha make contact with each other and the materials in each dense phase riser reactor 101 move upwards. In embodiments of the invention, the naphtha at the contacting step of block 201 comprises a hydrocarbon mixture with a final boiling point lower than 350° C. In embodiments of the invention, reaction conditions at block 201 may include a superficial gas velocity (SGV) in a fluidized bed of each dense phase riser reactor 101 greater than 12 m/s, and preferably 12 to 21 m/s and all ranges and values there between including ranges of 12 to 13 m/s, 13 to 14 m/s, 14 to 15 m/s, 15 to 16 m/s, 16 to 17 m/s, 17 to 18 m/s, 18 to 19 m/s, 19 to 20 m/s, and 20 to 21 m/s. According to embodiments of the invention, at block 201, reaction conditions include a solid volume fraction (SVF) for a fluidized catalyst bed of each dense phase riser reactor 101 in a range of 0.06 to 0.12 and all ranges and values there between including ranges of 0.06 to 0.07, 0.07 to 0.08, 0.08 to 0.09, 0.09 to 0.10, 0.10 to 0.11, and 0.11 to 0.12. The reaction conditions at block 201 may include a reaction temperature of 670 to 730° C. and all ranges and values there between including ranges of 670 to 680° C., 680 to 690° C., 690 to 700° C., 700 to 710° C., 710 to 720° C., and 720 to 730° C. The reaction conditions at block 201 may further include a reaction pressure of 1 to 3 bar and all ranges and values there between including ranges of 1 to 1.5 bar, 1.5 to 2.0 bar, 2.0 to 2.5 bar, and 2.5 to 3.0 bar. The reaction conditions at block 201 may further include an average residence time in each dense phase riser reactor 101 of 1 to 15 s and all ranges and values there between 1 to 3 s, 3 to 6 s, 6 to 9 s, 9 to 12 s, 12 to 15 s. The reaction conditions at block 201 may further include a weighted hourly space velocity in a range of 0.3 to 3 $hr^{-1}$ and all ranges and values there between including ranges of 0.3 to 0.6 $hr^{-1}$, 0.6 to 0.9 $hr^{-1}$, 0.9 to 1.2 $hr^{-1}$, 1.2 to 1.5 $hr^{-1}$, 1.5 to 1.8 $hr^{-1}$, 1.8 to 2.1 $hr^{-1}$, 2.1 to 2.4 $hr^{-1}$, 2.4 to 2.7 $hr^{-1}$, and 2.7 to 3.0 $hr^{-1}$.

According to embodiments of the invention, the catalyst of dense phase riser reactors 101 includes zeolite. The catalyst particles may have a density of 1000 to 1200 $kg/m^3$ and all ranges and values there between including ranges of 1000 to 1010 $kg/m^3$, 1010 to 1020 $kg/m^3$, 1020 to 1030 $kg/m^3$, 1030 to 1040 $kg/m^3$, 1040 to 1050 $kg/m^3$, 1050 to 1060 $kg/m^3$, 1060 to 1070 $kg/m^3$, 1070 to 1080 $kg/m^3$, 1080 to 1090 $kg/m^3$, 1090 to 1100 $kg/m^3$, 1100 to 1110 $kg/m^3$, 1110 to 1120 $kg/m^3$, 1120 to 1130 $kg/m^3$, 1130 to 1140 $kg/m^3$, 1140 to 1150 $kg/m^3$, 1150 to 1160 $kg/m^3$, 1160 to 1170 $kg/m^3$, 1170 to 1180 $kg/m^3$, 1180 to 1190 $kg/m^3$, and 1190 to 1200 $kg/m^3$. At block 201, each dense phase riser reactor 101 may be operated at a catalyst bed bulk density of 70 to 145 $kg/m^3$ and all ranges and values there between including ranges of 70 to 75 $kg/m^3$, 75 to 80 $kg/m^3$, 80 to 85 $kg/m^3$, 85 to 90 $kg/m^3$, 90 to 95 $kg/m^3$, 95 to 100 $kg/m^3$, 100 to 105 $kg/m^3$, 105 to 110 $kg/m^3$, 110 to 115 $kg/m^3$, 115 to 120 $kg/m^3$, 120 to 125 $kg/m^3$, 125 to 130 $kg/m^3$, 130 to 135 $kg/m^3$, 135 to 140 $kg/m^3$, and 140 to 145 $kg/m^3$.

According to embodiments of the invention, at block 201, the lift gas and the naphtha are flowed into each dense phase riser reactor 101 at a volumetric ratio of 0.4 to 0.8 and all ranges and values there between including ranges of 0.4 to 0.5, 0.5 to 0.6, 0.6 to 0.7, and 0.7 to 0.8. Each dense phase riser reactor 101 may include a catalyst bed having a catalyst to oil ratio of 10 to 50 and all ranges and values there between including ranges of 10 to 15, 15 to 20,20 to 25,25 to 30, 30 to 35, 35 to 40, 40 to 45, and 45 to 50.

According to embodiments of the invention, as shown in block 202, method 200 further includes flowing an effluent from each dense phase riser reactor 101 including a mixture of the first product, the catalyst particles, and unreacted naphtha to a cyclone system disposed in secondary reactor 107. The effluent from each dense phase riser reactor 101 may further include the lift gas. In embodiments of the invention, the flowing at block 202 is propelled by the lift gas and/or the feed. Non-limiting examples of the lift gas may include nitrogen, methane, any inert gas, steam, or combinations thereof.

According to embodiments of the invention, as shown in block 203, method 200 further comprises separating the first product from the catalyst particles in the cyclone system of secondary reactor 107. In embodiments of the invention, the separation at block 203 includes gas-solid separation to produce a gas product stream and a spent catalyst stream. According to embodiments of the invention, the gas product stream comprises the first product. In embodiments of the invention, the first product includes light olefins ($C_2$ to $C_4$ olefins), unreacted naphtha, aromatics, lift gas, by-products, or combinations thereof. The first product may further comprise unreacted naphtha, the lift gas, aromatics including BTX, or combinations thereof. The first product may have a weight ratio of light olefins to BTX in a range of 2 to 4 and all ranges and values there between including ranges of 2 to 2.2, 2.2 to 2.4, 2.4 to 2.6, 2.6 to 2.8, 2.8 to 3.0, 3.0 to 3.2, 3.2 to 3.4, 3.4 to 3.6, 3.6 to 3.8, and 3.8 to 4.0. The yield of light olefins may be in a range of 45 to 48% and all ranges and values there between including ranges of 45 to 46%, 46 to 47%, and 47 to 48%. The separating at block 203 may include passing the effluent of each dense phase riser reactor 101 through one or more cyclones of secondary reactor 107. In embodiments of the invention, the product gas stream comprises 45 to 48 wt. % light olefins.

According to embodiments of the invention, as shown in block 204, method 200 includes stripping, in stripper 111, which is disposed in regenerator 110, hydrocarbon vapor from the catalyst particles to produce stripped catalyst particles. In embodiments of the invention, the hydrocarbon vapor is adsorbed on the catalyst particles before the stripping at block 204. In embodiments of the invention, at block 204, a volumetric ratio of stripping gas to catalyst particles is in a range of 0.02 to 0.65 and all ranges and values there between including ranges of 0.02 to 0.09, 0.09 to 0.16, 0.16 to 0.23, 0.23 to 0.30, 0.30 to 0.37, 0.37 to 0.44, 0.44 to 0.51, 0.51 to 0.58, and 0.58 to 0.65.

According to embodiments of the invention, as shown in block 205, method 200 includes regenerating, in regenerator 110, the stripped catalyst particles. In embodiments of the invention, at block 205, the catalyst particles are regenerated in the presence of air. The regenerating at block 205 may be conducted at a regeneration temperature of 680 to 750° C. and all ranges and values there between including ranges of 680 to 690° C., 690 to 700° C., 700 to 710° C., 710 to 720° C., 720 to 730° C., 730 to 740° C., and 740 to 750° C. In embodiments of the invention, the regenerating at block 205 produces regenerated catalyst and flue gas. The flue gas may be separated from the regenerated catalyst in cyclone(s) 118. In embodiments of the invention, the regenerated catalyst is flowed to each dense phase riser reactor 101 through catalyst outlet(s) 117 (and/or 117') and catalyst inlet(s) 105 (and/or 105'). In embodiments of the invention, the catalytic cracking of method 200 has a yield of light olefins greater than 45%.

Although embodiments of the present invention have been described with reference to blocks of FIG. 2, it should be appreciated that operation of the present invention is not limited to the particular blocks and/or the particular order of the blocks illustrated in FIG. 2. Accordingly, embodiments of the invention may provide functionality as described herein using various blocks in a sequence different than that of FIG. 2.

The systems and process described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

As part of the disclosure of the present invention, a specific example is included below. The example is for illustrative purposes only and is not intended to limit the invention. Those of ordinary skill in the art will readily recognize parameters that can be changed or modified to yield essentially the same results.

EXAMPLE 1

(Production of Light Olefins via Catalytic Cracking)

Experiments on the production of light olefins via catalytic cracking were conducted a in pilot-scale reaction unit of the present invention. The dense-phase riser reactor in the pilot-scale reaction unit was operated with high solid volume fractions and minimum backing mixing to maximize light olefin yields. The composition of the feedstock used in these experiments are shown in Table 1.

TABLE 1

| Feedstock composition | | | | | |
|---|---|---|---|---|---|
| Normal paraffin (wt. %) | Iso-paraffin (wt. %) | Naphthenic species (wt. %) | Aromatics (wt. %) | Olefins (wt. %) | Others (wt. %) |
| 22-24 | 27-30 | 32-35 | 11-13 | <0.5 | <8 |

The reaction conditions for the reaction unit included a reaction temperature of 700° C., a catalyst regeneration temperature 710° C., a reaction pressure of 1.50 atm, a contact time of 1.03 to 1.16 seconds, a catalyst-to-oil ratio of 30, and a weight hourly space velocity (WHSV) of 1.9 $h^{-1}$. The results of the yields of each major product for the experiments are shown in Table 2.

TABLE 2

| Results from the pilot scale experiments | |
|---|---|
| | HD 3 m max Olefins* |
| CH4 | <10 |
| C2H4 | 14-16 |
| C2H4 + C3H6 | >35 |
| C2H4 + C3H6 + C4H8 | >46 |
| BTX | 14-16 |
| C2H4 + C3H6 + C4H8 + BTX | >60 |
| C3H6/C2H4 ratio | 1.3-1.5 |
| C2H4 + C3H6 + C4H8/BTX ratio | >3 |

Table 2 shows the composition of the product stream produced in the pilot plant. The results show that the yields of light olefins including $C_2$ to $C_4$ olefins have a combined yield of more than 46%.

In the context of the present invention, at least the following 19 embodiments are described. Embodiment 1 is a method of producing light olefins. The method includes contacting, in a plurality dense phase riser reactors, naphtha with catalyst particles under reaction conditions sufficient to produce a first product containing one or more olefins, wherein the reaction conditions include a solid volume fraction of 0.06 to 0.12 in each of the dense phase riser reactors. The method further includes flowing a mixture of the first product, the catalyst particles, and unreacted naphtha to a cyclone system located in a secondary reactor, wherein the secondary reactor is stacked on top of a catalyst regenerator. Embodiment 2 is the method of embodiment 1, wherein the reaction conditions include a contact time between naphtha and catalyst particles in a range of 1 to 2 seconds. Embodiment 3 is the method of any of embodiments 1 or 2, wherein the reaction conditions include a superficial gas velocity in the dense phase riser reactors in a range of 12 to 21 m/s. Embodiment 4 is the method of any of embodiments 1 to 3, wherein the reaction conditions further include a reaction temperature in a range of 670 to 730° C., a reaction pressure in a range of 1 to 3 bar, and a weight hourly space velocity in a range of 0.3 to 3 $hr^{-1}$. Embodiment 5 is the method of any of embodiments 1 to 4, wherein the dense phase riser reactors are operated such that there is substantially no back mixing of materials in the dense phase riser reactors. Embodiment 6 is the method of any of embodiments 1 to 5, wherein the dense phase riser reactors are operated such that reaction kinetics in the dense phase riser reactors substantially follows plug flow reactors. Embodiment 7 is the method of any of embodiments 1 to 6, further including separating, in the cyclone system, the first product from the catalyst particles. The method further includes stripping, in a stripper located in the catalyst regenerator, hydrocarbon vapor from the catalyst particles to produce stripped catalyst particles. The method still further includes regenerating, in the catalyst regenerator, the stripped catalyst particles. Embodiment 8 is the method of any of embodiments 1 to 7, wherein the dense phase riser reactors are operated using a lift gas selected from the group consisting of nitrogen, methane, any inert gas, and combinations thereof. Embodiment 9 is the method of embodiment 8, wherein the lift gas contains less than 10 wt. % steam. Embodiment 10 is the method of any of embodiments 1 to 9, wherein the catalyst contains a zeolite based catalyst. Embodiment 11 is the method of any of embodiments 1 to 10, wherein the catalyst includes particles of average diameter in a range of 75 to 120 μm. Embodiment 12 is the method of any of embodiments 1 to 11, wherein the catalyst has a particle density of 1000 to 1200 $kg/m^3$. Embodiment 13 is the method of any of embodiments 1 to 12, wherein each of the dense phase riser reactors includes a fluidized bed having a catalyst to oil ratio of 10 to 50. Embodiment 14 is the method of embodiment 13, wherein the fluidized bed in each dense phase riser reactor has a bulk density in a range of 70 to 145 $kg/m^3$. Embodiment 15 is the method of any of embodiments 1 to 14, wherein the dense phase riser reactors are operated at a volumetric feed to lift gas ratio of 1.25 to 2.5.

Embodiment 16 is a reaction unit for producing aromatics. The reaction unit includes a plurality of dense phase riser reactors, wherein each of the dense phase riser reactors includes a housing. The reactor unit further includes a feed inlet located on a lower half of the housing and adapted to receive a feed material into the housing. The method still further includes a lift gas inlet located on the bottom of the housing and adapted to receive a lift gas into the housing The reaction unit also includes a catalyst inlet located at the bottom of the housing and adapted to receive catalyst into the housing. In addition, the reaction unit includes an outlet located on top of the housing and adapted to release an effluent of the dense phase riser from the housing. The reaction unit further includes a secondary reactor in fluid communication with the outlet of each dense phase riser reactor, wherein the secondary reactor includes one or more cyclones adapted to separate the effluent of each of the dense phase risers to form a gaseous stream containing gaseous products and a solid stream containing a catalyst. The reaction unit still further includes a regenerator in fluid communication with the secondary reactor, adapted to receive the solid stream from the secondary reactor and regenerate the catalyst of the solid stream, wherein the secondary reactor is stacked on top of the regenerator and the regenerator is in fluid communication with the catalyst inlet of each of the dense phase riser reactors. Embodiment 17 is the reaction unit of embodiment 16, wherein the regenerator further includes a stripper adapted to strip hydrocarbons adsorbed on catalyst particles of the solid stream using a stripping gas before the catalyst is regenerated. Embodiment 18 is the reaction unit of embodiment 17, wherein the stripping gas contains nitrogen, methane, flue gas, or combinations thereof. Embodiment 19 is the reaction unit of any of embodiments 16 to 18, wherein the regenerator further includes one or more cyclones adapted to separate flue gas from the catalyst.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method of producing light olefins; the method comprising:

contacting, in a plurality of dense phase riser reactors, naphtha with catalyst particles under reaction conditions sufficient to produce a first product comprising one or more light olefins, wherein the reaction conditions comprise a solid volume fraction of 0.06 to 0.12 in each of the dense phase riser reactors; and flowing a mixture of the first product, the catalyst particles, and unreacted naphtha to a cyclone system disposed in a secondary reactor, wherein the secondary reactor is stacked on top of a catalyst regenerator, wherein the reaction conditions comprise a superficial gas velocity in the dense phase riser reactors in a range of 12 to 21 m/s.

2. The method of claim 1, wherein the reaction conditions further comprise a weight hourly space velocity in a range of 0.3 to 3 $hr^{-1}$.

3. The method of claim 1, wherein the dense phase riser reactors are operated such that there is substantially no back mixing of materials in the dense phase riser reactors.

4. The method of claim 1, wherein the dense phase riser reactors are operated such that reaction kinetics in the dense phase riser reactors substantially follows plug flow reactors.

5. The method of claim 1, further comprising:

separating, in the cyclone system, the first product from the catalyst particles;

stripping, in a stripper disposed in the catalyst regenerator, hydrocarbon vapor from the catalyst particles to produce stripped catalyst particles; and regenerating, in the catalyst regenerator, the stripped catalyst particles.

6. The method of claim 1, wherein the dense phase riser reactors are operated using a lift gas selected from the group consisting of nitrogen, methane, any inert gas, and combinations thereof.

7. The method of claim 6, wherein the lift gas contains less than 10 wt. % steam.

8. The method of claim 1, wherein the catalyst comprises a zeolite based catalyst.

9. The method of claim 1, wherein the catalyst comprises particles of average diameter in a range of 75 to 120 μm.

10. The method of claim 1, wherein the catalyst has a particle density of 1000 to 1200 $kg/m^3$.

11. The method of claim 1, wherein each of the dense phase riser reactors comprises a fluidized bed having a catalyst to oil ratio of 10 to 50.

12. The method of claim 11, wherein the fluidized bed in each dense phase riser reactor has a bulk density in a range of 70 to 145 $kg/m^3$.

13. The method of claim 1, wherein the dense phase riser reactors are operated at a volumetric feed to lift gas ratio of 1.25 to 2.5.

14. The method of claim 1, wherein the reaction conditions further comprise a reaction temperature in a range of 670 to 730° C., a reaction pressure in a range of 1 to 3 bar, and a weight hourly space velocity in a range of 0.3 to 3 $hr^{-}1$.

15. The method of claim 14, wherein the dense phase riser reactors are operated such that there is substantially no back mixing of materials in the dense phase riser reactors.

16. The method of claim 1, wherein the dense phase riser reactors are operated such that reaction kinetics in the dense phase riser reactors follows plug flow reactors.

17. The method of claim 1, further comprising:

separating, in the cyclone system, the first product from the catalyst particles.

18. The method of claim 1, wherein the dense phase riser reactors are operated using a lift gas.

* * * * *